US006481808B2

(12) United States Patent
Cinese

(10) Patent No.: US 6,481,808 B2
(45) Date of Patent: Nov. 19, 2002

(54) DEVICE FOR CARRYING, DISPLAYING AND DISPENSING MEDICAL ARTICLES

(76) Inventor: Antonio Enrique Cinese, Alvar Nunex 322 Piso 1, Ciudad de Buenos Aires (AR)

( * ) Notice: Subject to any disclaimer, the term of this patent is extended or adjusted under 35 U.S.C. 154(b) by 0 days.

(21) Appl. No.: 09/870,076

(22) Filed: May 30, 2001

(65) Prior Publication Data

US 2001/0054862 A1 Dec. 27, 2001

(30) Foreign Application Priority Data

Jun. 26, 2000 (AR) ..... M000103211

(51) Int. Cl.[7] ..... A47F 3/14; A47B 81/00

(52) U.S. Cl. ..... 312/118; 312/209; 312/234; 312/249.8; 312/351.2; 108/147.21

(58) Field of Search ..... 312/249.8, 209, 312/114, 117, 118, 234, 234.1, 234.4, 327, 351.2; 108/25, 147.19, 147.21, 150

(56) References Cited

U.S. PATENT DOCUMENTS

| | | | | |
|---|---|---|---|---|
| RE4,190 E | * 11/1870 | Loomis | 312/351.2 X |
| 761,468 A | * 5/1904 | Ford | 108/147.21 |
| 1,106,543 A | * 8/1914 | Burnham et al. | 312/234 X |
| 1,644,830 A | * 10/1927 | Henderson | 312/209 |
| 3,627,122 A | * 12/1971 | Garbe, Jr. | 312/209 X |
| 3,874,758 A | * 4/1975 | Isaacs | 312/234 X |
| 4,285,558 A | * 8/1981 | Medford | 312/117 X |
| 4,491,218 A | 1/1985 | Aday | 206/63.3 |
| 4,652,062 A | * 3/1987 | Greenwood | 312/209 |
| 5,460,263 A | 10/1995 | Brown et al. | 206/63.3 |
| 5,496,103 A | * 3/1996 | Kozak | 312/118 |
| 5,667,155 A | 9/1997 | Cerwin et al. | |
| 5,675,961 A | 10/1997 | Cerwin et al. | 206/63.3 X |
| 5,788,062 A | 8/1998 | Cerwin et al. | 206/63.3 |
| 5,860,517 A | 1/1999 | Gemma, Jr. et al. | 206/63.3 |
| 5,912,818 A | 6/1999 | McGrady et al. | |
| 5,988,367 A | 11/1999 | Gemma, Jr. et al. | 206/63.3 |

FOREIGN PATENT DOCUMENTS

| | | | |
|---|---|---|---|
| FR | 2647653 | * 12/1990 | 312/118 |
| GB | 830672 | * 3/1960 | 312/118 |

* cited by examiner

*Primary Examiner*—James O. Hansen
(74) *Attorney, Agent, or Firm*—Greer, Burns & Crain, Ltd.

(57) ABSTRACT

A device for carrying and displaying medical articles, wherein the device comprises an upper cabinet with a top transparent lid hinged to a back wall of the cabinet and capable of being opened around the hinged connection, the cabinet housing a plurality of boxes which in turn define corresponding divisions by a plurality of partition walls, for organizing the articles into separate spaces within each box, the cabinet being mounted at an upper end of a supporting stand for mounting the device from the floor.

10 Claims, 2 Drawing Sheets

DEVICE FOR CARRYING, DISPLAYING AND DISPENSING MEDICAL ARTICLES

BACKGROUND OF THE INVENTION

1. Field of the Invention

The present invention relates to the medical field and more particularly refers to a cabinet for containing medical items or articles and, still more particularly the invention refers to a mobile device for containing, carrying, displaying and dispensing medical articles such as sutures, surgical instruments, catheters, pads and several other material that may be needed in Health Centers, Hospitals, Emergency Rooms, Operating Rooms, Physician Offices, etc.

2. Description of the Prior Art

It is well known to provide suture dispenser boxes for containing sutures and facilitating the dispensing thereof by means of several supports, envelopes, pouches, winding fixtures and similar devices, all for containing individual suture units. These several packages are disclosed in U.S. Pat. Nos. 4,491,218; 5,460,263; 5,667,155; 5,675,961; 5,788,062; 5,912,818; 5,860,517 and 5,988,367.

These packages are generally stocked in a safe room outside the operating room or the emergency room where such materials are usually necessary. Upon an emergency or a programmed surgical operation a surgery assistant must select some sutures among those ones indicated by the physician and bring the individual suture packages to the emergency or operating room. While this seems to be not so important in a programmed operation, the time taken by selecting the sutures and bringing the suture packages to the room where they must be used becomes of extreme importance upon an emergency event occurring in an emergency room or during an operation.

It would be therefore convenient to have a device capable of accommodating and organizing several medical articles in order to have an easy and quick access to the articles when they are needed, the device being preferably capable of being moved and carried by one person with all the desired material for supplying the material in sterile conditions in the desired room.

SUMMARY OF THE INVENTION

It is therefore an object of the present invention to provide a device for carrying several items, such as medical items, and for displaying the articles, as well as for providing easy and quick access to the articles during an emergency in an emergency room, or during a surgical operation in an operating room.

It is still another object of the present invention to provide a device for carrying and displaying medical articles, wherein the device comprises an upper cabinet with a top transparent lid hinged to a back wall of the cabinet and capable of being opened around the hinged connection, the cabinet housing a plurality of boxes that in turn define corresponding divisions by a plurality of partition walls, for organizing the articles into separate spaces within each box, the cabinet being mounted at an upper end of a supporting stand for mounting the device from the floor.

It is a further object of the present invention to provide a device for carrying and displaying medical articles, the device comprising an upper forwardly inclined cabinet defined by a bottom wall and front, back and side walls upwardly extending from the bottom wall and a top lid having a back portion hinged to the back wall and a front portion, wherein the lid can be lifted by upwardly pulling from the lid for pivoting the lid around the hinged portion and opening the box in order to have access to an interior of the cabinet; a plurality of upwardly open boxes within the cabinet, each box defined by a floor and front, back and side walls upwardly extending from the floor of the box, with the front wall being forwardly inclined and defining a viewer containing indicia related to the articles housed in the box; a plurality of partition walls for organizing the articles into separate spaces within each box, each partition wall including at least one window tab for containing specific indicia related to the articles housed in an associated space; locking means in the lid and cabinet for locking the lid into a closed position in the cabinet; and a supporting stand for mounting the device from the floor.

The above and other objects, features and advantages of this invention will be better understood when taken in connection with the accompanying drawings and description.

BRIEF DESCRIPTION OF THE DRAWINGS

The present invention is illustrated by way of example in the following drawings wherein.

DESCRIPTION OF THE PREFERRED EMBODIMENTS

Figure 2:
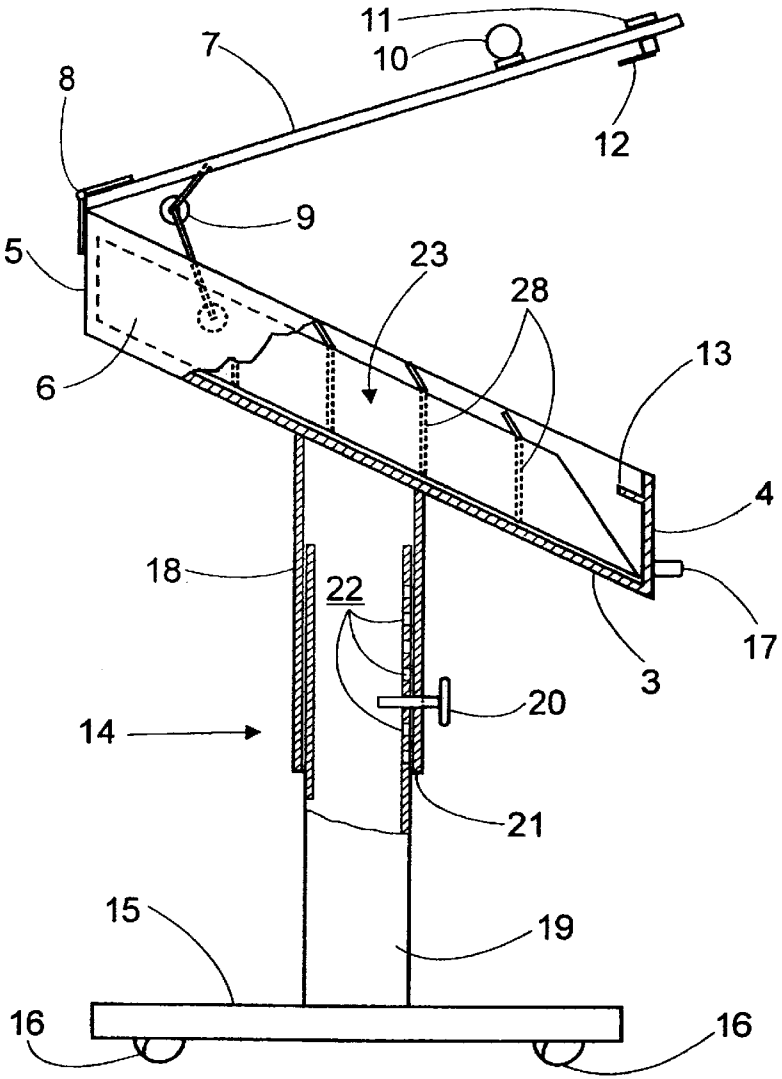
FIG. 2 shows a side elevation, partially cross-sectional view of the device of FIG. 1, with the lid shown in an open position.
Figure 1:
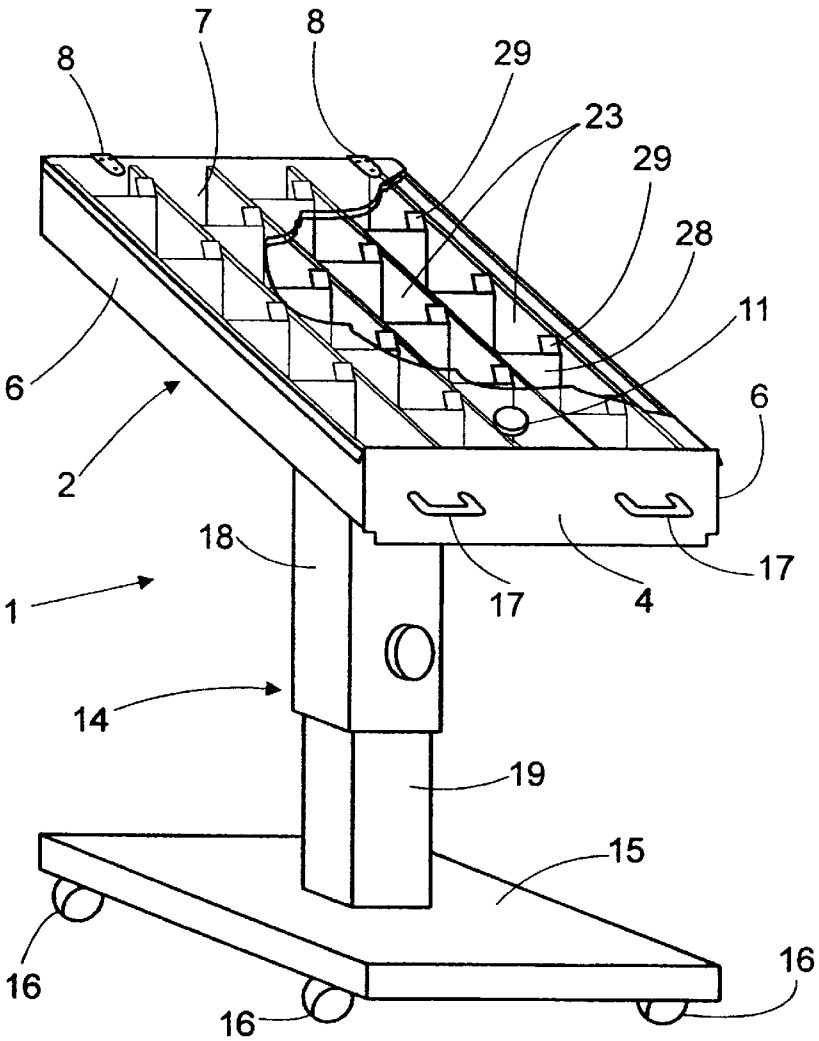
FIG. 1 shows a top perspective, partially cross-sectional view of a suture dispensing device according to a preferred embodiment of the invention.

Now referring in detail to the drawings it may be seen from FIGS. 1 and 2, a device according to the invention, for containing, carrying and displaying medical articles, preferably sutures, the device being indicated by the general reference number 1. Device 1 comprises an upper cabinet 2, forwardly inclined at a preferred 30° angle, the cabinet being preferably made of any appropriate light material, such as plastics, easy to clean and maintain, preferably with capacity to be sterilized. Cabinet 2 is defined by a bottom wall 3 and a front 3, a back 4 and side 6 walls, all upwardly extending from bottom wall 3. A top lid 7 preferably made from a transparent material, such as a plastic, is pivotally connected to the cabinet whereby the lid can be pivotally moved into a closed position, as shown in FIG. 1 or into an open position. FIG. 2 shows the lid in a partial open position.

Lid 7 has a back portion hinged to back wall 5 of the cabinet by means of hinges 8, however, an additional hinge, such as an offset hinge arm 9 may be provided at each side wall 6 in order to facilitate the opening of lid 7 and permits the lid to desirably remain at an intermediate open position, as it is shown in FIG. 2. Lid 7 may be also provided, at a front portion thereof, with a pulling knob 10 whereby the lid can be lifted by upwardly pulling from the knob for pivoting the lid around the hinged portion, at hinges 8, and opening the box in order to have access to an interior of the cabinet. In addition, lid 7 is preferably provided with locking means, such as a key operated lock 11 having a locking tongue 12 capable of being locked under stationary tongue 13 at the interior of front wall 4 of the cabinet. Thus, lid 7 can be locked into a closed position against the cabinet and the control of the contents of the cabinet can be safely assigned to one or more registered persons.

Cabinet 2 is mounted onto a supporting stand generically indicated by reference number 14, preferably a stand capable of being conveyed onto the floor, for which purpose the stand comprises a bottom end connected to a supporting base 15 that includes carrying means, such as rolling wheels 16 for conveying the device onto the floor. For moving the device on the floor, cabinet 2 is provided at front wall 4 thereof with one or more front pulling handles 17.

More particularly, supporting stand 14 is comprised of an upper tubular portion 18 and a bottom tubular portion 19, both portions being telescopically arranged with lower portion 19 being slidably arranged into upper portion 18. As it is clear from FIGS. 1 and 2, cabinet 2 is fixed to upper portion 18 and bottom portion 19 is fixed to base 15. In addition, stand 14 includes height regulating means, preferably constituted by a threaded-pin-knob 20 that may be inserted thorough an orifice 21 provided in a front side of upper tubular portion 18 and through one of a plurality of orifices 22 provided at a front side of bottom tubular portion 19, whereby the stand extension can be regulated and fixed into a desired relative position in order to place the cabinet at a desired height.

Figure 3:
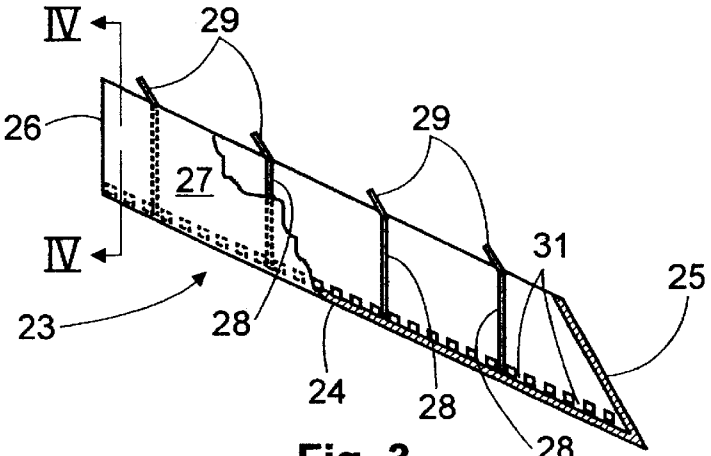
FIG. 3 shows a side elevation, partially cross-sectional view of one of the boxes that are accommodated within the cabinet of the device of FIGS. 1 and 2.
Figure 4:
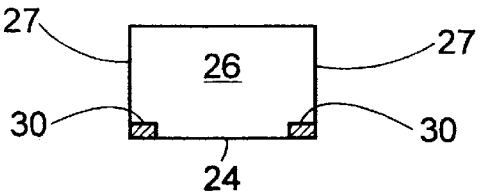
FIG. 4 shows a cross-sectional view of the box of FIG. 3, taken at cut line IV—IV of FIG. 3.
Figure 5:
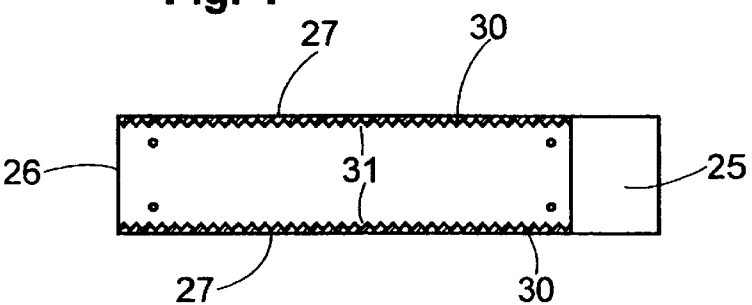
FIG. 5 shows a top plan view of the box of FIG. 3.

As it is shown in FIGS. 1 and 2, cabinet 2 accommodates one or more upwardly open boxes 23 within the cabinet, and, as shown in FIGS. 3–5, each box is defined by a floor 24 and a front 25, a back 26 and side 27 walls upwardly extending from floor 24 of the box: Preferably, front wall 25 is forwardly inclined forming a 150° angle with the horizon, and defines a kind of window or viewer containing indicia related to the articles housed in the box; such indicia may relate to the size of the suture and type of the needle.

A plurality of partition walls 28 are provided into each box 23 for organizing the articles into separate spaces within each box. Each partition wall 28 may be made of any appropriate material compatible with the cabinet and box and may include at least one window tab 29 for containing specific indicia related to the articles housed in an associated space. With the lid being transparent the window tab 29 of each partition wall is visible through the lid. Each partition wall 28 extends upwardly from floor 24 of the corresponding box and the window tab is at an upper edge of the partition wall. Each box 23 is also provided with retaining means, preferably a pair of strips 30, one at each side of the box, each strip including a plurality of projections and recesses 31, wherein each recess 31 receives a corresponding partition wall, as shown in FIG. 3, and retains the partition wall in the desired location to define the desired divisions for containing the sutures.

Figure 6:
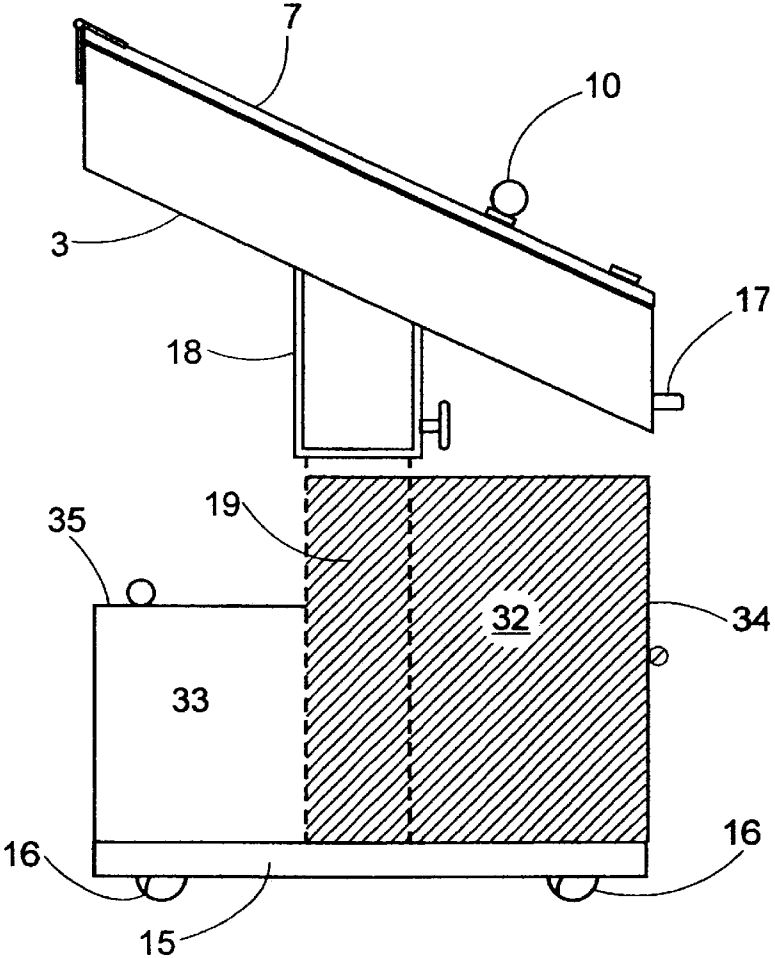
FIG. 6 shows a side elevation view of the device according to another embodiment of the invention, with the lid shown in a close position.

FIG. 6 shows another alternative embodiment of the device of the present invention, wherein the cabinet 2 with the boxes therein, the supporting stand and rolling base 15 is practically the same that the ones shown in the previously described Figures. This embodiment, however, includes at least one auxiliary cabinet 32, 33, for containing medical material. Each compartment 32, 33 is provided with its own door 34 and 35 either at a front or at the top of the corresponding compartment.

As it may be seen from the above detailed description, the inventive device provides for a quick access to the storage and classified suture articles as well as a quick release of the articles, this being very important for providing comfort to the assistant in charge of the instrumentation and mostly important, this inventive device provides a quick reply to the surgery staff during an urgent surgery operation. In addition, by means of the present device, the use of the suture stock and any other items stock can be easily and efficiently controlled as long as the same are neatly and carefully classified and stocked, ready for use.

The present device has been developed and created based in the expertise acquired by seeing the handling and managing of sutures and other medical items, such as surgical articles, which are extensively used in emergency rooms, operating rooms and general treatment rooms of Hospitals and Medical Clinics and Centers. Thus, the present device is provided with constructive features that notably facilitates the task of the person in charge of the instruments and who is entrusted to assist the physician or surgeon by supplying him with the sutures and surgical accessories required by the medical professionals during the surgical operation. In addition, the special design of the inventive device provides for a quick selection of the proper suture during any emergency that may arise during the operation, thus reducing at a minimum the time necessary for identifying the needed suture or surgical material to be employed.

In addition to the foregoing, the locking means provided in the device permits assign the responsibility about the stock control of sutures and medical material to selected person(s) of the medical personnel, who can maintain a record or log, as well as precise statistics, of the items used during the operations, thus minimizing the possibilities of theft and stealing of medical material.

While preferred embodiments of the present invention have been illustrated and described, it will be obvious to those skilled in the art that various changes and modifications may be made therein without departing from the scope of the invention as defined in the appended claims.

I claim:

1. A device for carrying and displaying medical articles, the device comprising:

an upper forwardly inclined cabinet defined by a bottom wall and front, back and side walls upwardly extending from the bottom wall and a top lid having a back portion hinged to the back wall and a front portion, wherein the lid can be lifted by upwardly pulling from the lid for pivoting the lid around the hinged portion and opening the box in order to have access to an interior of the cabinet;

a plurality of upwardly open boxes within the cabinet, each box defined by a floor and front, back and side walls upwardly extending from the floor of the box, with the front wall being forwardly inclined and defining a viewer containing indicia related to the articles housed in the box;

a plurality of partition walls for organizing the articles into separate spaces within each box, each partition wall including at least one window tab for containing specific indicia related to the articles housed in an associated space;

locking means in the lid and cabinet for locking the lid into a closed position in the cabinet; and a supporting stand for mounting the device from the floor.

2. The device of claim 1, wherein the supporting stand has a bottom end connected to a supporting base including carrying means for conveying the device onto the floor.

3. The device of claim 1, wherein the supporting stand is comprised of an upper tubular portion and a bottom tubular portion, both tubular portions being telescopically arranged one into the other and including height regulating means, whereby the stand extension can be regulated and fixed in order to place the cabinet at a desired height.

4. The device of claim 1, further comprising offset hinge arms connecting the side walls of the cabinet and the lid.

5. The device of claim 1, further comprising a front handle in the front wall of the cabinet for pulling from the device and carrying the same onto the floor.

6. The device of claim 1, wherein the lid is transparent and the window tab of each partition wall is visible through the lid.

7. The device of claim 6, wherein each partition walls extends upwardly from the floor of the corresponding box and the window tab is at an upper edge of the partition wall.

8. The device of claim 1, further comprising an auxiliary cabinet for containing medical material.

9. The device of claim 1, wherein the articles comprise sutures and the indicia relates to the type of suture material and a needle that are contained in corresponding boxes.

10. The device of claim 1, wherein each box is provided with a pair of retaining strips, one at each side of the box, each strip including a plurality of projections and recesses, wherein each recess receives a corresponding partition wall and retains the partition wall in a desired location to define desired divisions for containing the sutures.

* * * * *